US009114055B2

(12) United States Patent
Edelman et al.

(10) Patent No.: US 9,114,055 B2
(45) Date of Patent: Aug. 25, 2015

(54) DEEP VEIN THROMBOSIS ("DVT") AND THERMAL/COMPRESSION THERAPY SYSTEMS, APPARATUSES AND METHODS

(75) Inventors: Howard Edelman, San Francisco, CA (US); Scott Ganaja, San Luis Obispo, CA (US); Aaron Alexander Selig, Mill Valley, CA (US); Xiao Li, Mountain View, CA (US)

(73) Assignee: Cothera LLC, Plano, TX (US)

( * ) Notice: Subject to any disclaimer, the term of this patent is extended or adjusted under 35 U.S.C. 154(b) by 691 days.

(21) Appl. No.: 13/419,022

(22) Filed: Mar. 13, 2012

(65) Prior Publication Data

US 2013/0245519 A1 Sep. 19, 2013

(51) Int. Cl.
*A61H 9/00* (2006.01)
*A61H 7/00* (2006.01)

(52) U.S. Cl.
CPC ..... *A61H 9/0092* (2013.01); *A61H 9/0078* (2013.01); *A61H 2201/0214* (2013.01); *A61H 2201/0242* (2013.01); *A61H 2201/5002* (2013.01); *A61H 2201/5071* (2013.01); *A61H 2209/00* (2013.01)

(58) Field of Classification Search
CPC ..... A61H 9/00; A61H 9/005; A61H 9/0078; A61H 23/04; A61H 2201/1238; A61H 2209/00
USPC ..... 601/148–152
See application file for complete search history.

(56) References Cited

U.S. PATENT DOCUMENTS 222,690 A 12/1879 Goldschmidt
1,896,953 A 5/1931 Hassell
2,260,134 A 10/1939 Ballman
2,726,658 A 12/1955 Chesseu
3,316,732 A 5/1967 Burton
(Continued)

FOREIGN PATENT DOCUMENTS

CA 2601496 3/2008
EP 1990039 11/2008
(Continued)

OTHER PUBLICATIONS

Orthofix International, "Orthofix International Introduces Fusion Lateral OA Brace With New Low-Profile Hinge," News Blaze, published Dec. 4, 2009, http://newsblaze.com/story/2009120405052100002.bw/topstory.html.
(Continued)

*Primary Examiner* — Justine Yu
*Assistant Examiner* — Christopher Miller
(74) *Attorney, Agent, or Firm* — K&L Gates LLP

(57) ABSTRACT

A pressure therapy system includes an air pump; a pneumatic line pressurized by the air pump; and a cuff in fluid communication with the pneumatic line, the cuff including flaps sized and shaped to extend around a user's limb, a first chamber and a second chamber separated fluidly by the cuff from the first chamber, wherein the pneumatic line splits into first and second line segments or openings, the first line segment or opening communicating fluidly with the first separated chamber, the second line segment or opening communicating fluidly with the second separated chamber, and wherein the second line segment or opening or a pathway of the cuff leading to the second separated chamber includes a flow restricting structure that delays pressurized air from reaching the second chamber relative to the first chamber.

14 Claims, 10 Drawing Sheets

(56) References Cited

U.S. PATENT DOCUMENTS 3,587,577 A 6/1971 Solyanka
3,625,279 A 12/1971 Mayo
3,648,765 A 3/1972 Starr
3,744,555 A 7/1973 Fletcher et al.
3,811,431 A 5/1974 Apstein
3,892,229 A 7/1975 Taylor et al.
3,901,221 A 8/1975 Nicholson et al.
3,918,458 A 11/1975 Nethery
3,942,518 A 3/1976 Tenteris et al.
3,971,398 A 7/1976 Taylor et al.
3,993,053 A 11/1976 Grossan
4,013,069 A 3/1977 Hasty
4,030,488 A 6/1977 Hasty
4,149,529 A 4/1979 Copeland et al.
4,156,425 A 5/1979 Arkans
4,186,732 A 2/1980 Christoffel
4,198,961 A 4/1980 Arkans
4,202,325 A 5/1980 Villari et al.
4,206,751 A 6/1980 Schneider
4,207,875 A 6/1980 Arkans
4,253,449 A 3/1981 Arkans et al.
4,306,747 A 12/1981 Moss
4,311,135 A 1/1982 Brueckner et al.
4,370,975 A 2/1983 Wright
4,375,217 A 3/1983 Arkans
4,396,010 A 8/1983 Arkans
4,453,538 A 6/1984 Whitney
4,501,126 A 2/1985 Norton
4,694,521 A 9/1987 Tominaga
4,773,494 A 9/1988 Anderson
4,821,354 A 4/1989 Little
4,841,956 A 6/1989 Gardner et al.
4,844,072 A 7/1989 French et al.
4,966,145 A 10/1990 Kikumoto et al.
5,022,387 A 6/1991 Hasty
5,109,832 A 5/1992 Proctor et al.
5,186,163 A 2/1993 Dye
5,218,954 A 6/1993 van Bemmelen
5,241,951 A 9/1993 Mason et al.
5,241,958 A 9/1993 Noeldner
5,261,482 A 11/1993 Lomax et al.
5,263,473 A 11/1993 McWhorter
5,330,519 A 7/1994 Mason et al.
5,370,603 A * 12/1994 Newman ..... 601/41
5,383,894 A 1/1995 Dye
5,496,262 A 3/1996 Johnson, Jr. et al.
5,588,955 A * 12/1996 Johnson et al. ..... 601/152
5,626,556 A 5/1997 Tobler et al.
5,647,051 A 7/1997 Neer
5,669,872 A 9/1997 Fox
5,730,136 A * 3/1998 Laufer et al. ..... 600/454
5,843,007 A 12/1998 McEwen et al.
5,865,841 A 2/1999 Kolen et al.
5,951,502 A 9/1999 Peeler et al.
5,968,073 A * 10/1999 Jacobs ..... 606/202
5,980,561 A 11/1999 Kolen et al.
5,989,285 A 11/1999 DeVilbiss et al.
6,007,559 A * 12/1999 Arkans ..... 606/201
6,080,120 A 6/2000 Sandman et al.
6,129,688 A 10/2000 Arkans
6,290,662 B1 9/2001 Morris et al.
6,296,617 B1 10/2001 Peeler et al.
6,358,219 B1 3/2002 Arkans
6,387,065 B1 5/2002 Tumey
6,436,064 B1 8/2002 Kloecker
6,440,093 B1 8/2002 McEwen et al.
6,447,467 B1 9/2002 Barak
6,463,612 B1 10/2002 Potter
6,463,934 B1 10/2002 Johnson, Jr. et al.
6,478,757 B1 11/2002 Barak
6,494,852 B1 12/2002 Barak et al.
6,544,202 B2 4/2003 McEwen et al.
6,589,194 B1 7/2003 Calderon et al.
6,592,534 B1 7/2003 Rutt et al.
6,685,661 B2 2/2004 Peled
7,044,924 B1 5/2006 Roth et al.
7,063,676 B2 6/2006 Barak et al.
7,191,798 B2 3/2007 Edelman et al.
7,207,959 B1 4/2007 Chandran
7,211,104 B2 5/2007 Edelman
7,282,038 B2 10/2007 Gillis et al.
7,354,410 B2 4/2008 Perry et al.
7,354,411 B2 4/2008 Perry et al.
7,637,879 B2 12/2009 Barak et al.
7,641,623 B2 1/2010 Biondo et al.
7,658,205 B1 2/2010 Edelman et al.
7,694,693 B1 4/2010 Edelman et al.
7,708,707 B2 5/2010 Cook et al.
7,819,829 B1 10/2010 Chandran
7,862,525 B2 1/2011 Carkner et al.
7,871,387 B2 1/2011 Tordella et al.
7,896,823 B2 3/2011 Mangrum et al.
7,909,783 B2 3/2011 Mayer et al.
7,909,861 B2 3/2011 Balachandran et al.
7,931,606 B2 4/2011 Meyer
7,942,838 B2 5/2011 Farrow
7,959,588 B1 6/2011 Wolpa
7,967,766 B2 6/2011 Ravikumar
8,394,042 B1 * 3/2013 Mirza ..... 601/150
2002/0115949 A1 * 8/2002 Kuslich et al. ..... 601/152
2004/0054306 A1 * 3/2004 Roth et al. ..... 601/152
2005/0070828 A1 * 3/2005 Hampson et al. ..... 601/152
2005/0187500 A1 * 8/2005 Perry et al. ..... 601/152
2006/0161081 A1 * 7/2006 Barak et al. ..... 601/151
2008/0058911 A1 3/2008 Parish et al.
2008/0077063 A1 3/2008 Meyer et al.
2009/0069731 A1 3/2009 Parish et al.
2009/0124944 A1 5/2009 Ravikumar
2009/0293887 A1 12/2009 Wilkes et al.
2009/0299239 A1 * 12/2009 Meyer et al. ..... 601/149
2009/0299249 A1 12/2009 Wilkes et al.
2009/0299255 A1 12/2009 Kazala et al.
2009/0299256 A1 12/2009 Barta
2009/0299257 A1 12/2009 Long et al.
2009/0299307 A1 12/2009 Barta et al.
2009/0299308 A1 12/2009 Kazala et al.
2009/0299340 A1 12/2009 Kazala et al.
2009/0299341 A1 12/2009 Kazala et al.
2009/0299342 A1 12/2009 Cavanaugh et al.
2010/0030306 A1 2/2010 Edelman et al.
2010/0081977 A1 * 4/2010 Vess ..... 602/13
2010/0100017 A1 4/2010 Maguina
2010/0106029 A1 * 4/2010 Fraden ..... 600/493
2010/0137764 A1 * 6/2010 Eddy ..... 601/152
2010/0210982 A1 * 8/2010 Balachandran et al. ..... 601/152
2010/0249679 A1 9/2010 Perry et al.
2011/0015587 A1 1/2011 Tumey et al.
2011/0015589 A1 1/2011 Svedman et al.
2011/0015590 A1 1/2011 Svedman et al.
2011/0015593 A1 1/2011 Svedman et al.
2011/0071447 A1 * 3/2011 Liu et al. ..... 601/151
2011/0077723 A1 3/2011 Parish et al.
2011/0082401 A1 4/2011 Iker et al.
2011/0087142 A1 * 4/2011 Ravikumar et al. ..... 601/151
2011/0092927 A1 4/2011 Wilkes et al.
2011/0093050 A1 4/2011 Damkoehler
2011/0152796 A1 6/2011 Kazala, Jr. et al.
2011/0166480 A1 7/2011 Mayer et al.
2011/0178481 A1 7/2011 Locke et al.
2011/0190675 A1 8/2011 Vess
2011/0196269 A1 8/2011 Arkans
2011/0245743 A1 * 10/2011 Eddy ..... 601/151
2011/0257573 A1 10/2011 Hong et al.
2011/0275983 A1 11/2011 Quisenberry et al.

FOREIGN PATENT DOCUMENTS

EP 2275165 1/2011
IE S950163 12/1995
WO WO2009/158131 12/2009
WO WO2011/090986 7/2011

(56) References Cited

OTHER PUBLICATIONS

Breg Incorporated, "Fusion OA," published 2009, http://www.breg.com/knee-bracing/oa/fusion-oa.html.

Bledsoe Brace Systems, "Bledsoe Cold Control," published 2008, http://bledsoebrace.com/products/ cold_control.asp.

International Preliminary Report on Patentability issued Oct. 25, 2013 for related Intl. Appin. No. PCT/US2012/029068.

* cited by examiner

DEEP VEIN THROMBOSIS ("DVT") AND THERMAL/COMPRESSION THERAPY SYSTEMS, APPARATUSES AND METHODS

BACKGROUND

The present disclosure relates generally to orthopedics and in particular to deep vein thrombosis ("DVT") and thermal/compression therapy systems, apparatuses and methods.

DVT is a condition that occurs when a blood clot forms in a patient's vein deep in the body, usually in the patient's legs or the feet. The clot can block proper blood flow and may lead to severe injury or death if the clot breaks off and travels through the bloodstream to other areas of the body, such as the brain or lungs. Doctors sometimes recommend compression therapy for people with or prone to developing DVT.

Compression therapy works by exerting varying degrees of pressure on the legs, especially the lower legs, which helps the blood to flow back towards the patient's heart. The pressure helps blood in the surface level veins travel to the deeper veins and back to the heart rather than collecting and clotting in the lower extremities. Compression therapy also helps to reduce pain and swelling associated with DVT.

One way to exert pressure on the patient's legs is via compression stockings. For a minimal amount of pressure, women's type pantyhose may be sufficient. If moderate support is required, over-the-counter compression stockings from a pharmacy or medical supply store may be used. There are also prescription strength compression stockings, which need to be fitted to the patient.

The patient should wear the compression stockings every day, as long as the patient is experiencing DVT-related symptoms or is at risk for developing DVT. The stockings should be worn throughout the day, even while exercising. The patient can remove the stockings for bathing and at night when while sleeping.

Patients who suffer from advanced arterial disease or poorly controlled congestive heart failure should not wear compression garments. Compression garments may worsen the disease in diabetics, smokers and those who have poor circulation in the legs if compression garments are worn. The compression garments can also cause skin infection.

If compression garments cannot be worn, or if additional DVT therapy is needed, pneumatic compression may be applied. For example, hospital patients that are bedridden or have recently undergone surgery are often treated with pneumatic compression devices to help prevent DVT. Known pneumatic compression devices include sleeves or cuffs that are applied around a patient's lower extremity and fastened removably by hook and pile straps for example. The cuffs are connected to a pump enabling the cuff to be inflated and deflated to aid in blood flow from the lower extremity back to the patient's heart.

As discussed, compression garments can be uncomfortable. This can be especially true in warmer climates. Compression garments are also not available to every DVT patient. And pneumatic compression devices have for the most part been used in hospitals. A need accordingly exists for a relatively low cost pneumatic compression device that can be used in the patient's home, in addition to or in the place of compression garments.

SUMMARY

The present disclosure provides a combination pressure therapy system, method and apparatus, for example, to treat deep vein thrombosis ("DVT") and other diseases, ailments and pain, such as sore muscles or joints. The system in one embodiment is microprocessor-based and includes electronics having at least one processor, memory device, power supply (e.g., to convert alternating current ("AC") voltage to direct current ("DC") voltage), and input/output switching. Input/output switching receives commands from the processor, according to a computer program stored on the memory device. The processor receives signals (e.g., via the input/output switching) from various sensors, such as pressure sensors. The processor in response to the signals (or to an input from the user) commands the input/output switching to control a pump and valves to nm a selected therapy.

The system includes a user interface, which includes on/off input devices or switches that allow the user to turn on and off one or more therapy of the system. The user interface may also have one or more display or readout, such as a temperature display for a thermal/compression therapy and/or a pressure readout for a DVT therapy. The system in one embodiment provides both a DVT therapy and a thermal/compression therapy. The user interface may include a master on/off switch that turns the system on and off and a second switch that controls just the thermal/compression therapy. Thus only the master switch needs to be turned on to run the DVT therapy in one embodiment. Both switches need to be turned on to runm only the thermal/compression therapy or to run both therapies.

The DVT therapy can include two pneumatic lines, each leading to a DVT cuff (e.g., left and right) in one embodiment. The pneumatic lines in an embodiment each operate with a control valve and a bleed valve. The valves can each be normally closed valves, such that the control valves are each opened to pressurize the lines (and cuffs) upon energization, while the bleed valves are each opened to depressurize the lines (and cuffs) upon energization. The pneumatic lines each include a pressure sensor or transducer, which sends a pressure signal back to the control electronics. The pressure signal is used as feedback to maintain the pressure in the lines at a preset, desired pressure. The bleed valves in one embodiment are adjustable to maintain a residual pressure in the pneumatic lines upon depressurization. Alternatively, the valves are depressurized to atmospheric pressure.

The DVT cuffs can be pressurized in many different ways in which the duration of the pressurization, the rate at which the maximum pressure is reached and the maximum pressure itself can be varied. In the illustrated embodiment below, the left and right cuffs are pressurized at different times so that the pump does not have to be sized to inflate both cuffs simultaneously. The cuffs could alternatively be pressurized at the same time or have overlapping pressurizations. In one embodiment illustrated below, the first cuff is inflated for six seconds from time zero and then deflated to a residual pressure. The second cuff is then inflated for six seconds beginning from time six seconds from zero to time twelve seconds from zero and then deflated to a residual pressure. After twelve seconds, both cuffs remain at the residual pressure until time sixty seconds from zero at which time the sequence just described is repeated. While the below example shows two cuffs, the system could alternatively provide and inflate one cuff or more than two cuffs, e.g., in a non-overlapping manner.

The system in one embodiment also provides a thermal/compression therapy wrap, which includes an inner chamber that receives a flow of water, e.g., chilled water, pumped from an ice bath, and an outer chamber that receives pressurized air. In one embodiment, the pressurization of the thermal/compression therapy wrap is controlled by the same processor that controls DVT cuff inflation, but is completely independent of DVT inflation and vice versa. Like with the DVT cuffs, the compression wrap can be pressurized in many different ways in which the duration of the pressurization, the rate at which the maximum pressure is reached, and the maximum pressure itself can be varied. In one embodiment illustrated below, pressure in the wrap is ramped up slowly, e.g. over forty-five seconds, in a linear manner, and then ramped down slowly, e.g. over forty-five seconds, in a linear manner. Pressure feedback is used with the electronics to control the desired waveform.

The thermal/compression pressure waveform can be run (i) by itself, (ii) while the DYT pressure waveforms are being run and in sync with or as part of an overall sequence or cycle with the DVT waveforms, or (iii) while the DVT pressure waveforms are being run and out of sync with or completely independent of the DVT waveforms. In either (ii) or (iii), the wrap can be inflated at the same time or at different times than the DVT cuffs are inflated. The thermal/compression therapy wrap can therefore be worn by itself or in combination with the DVT cuffs. While the DVT cuffs are generally worn at the lower portions of the user's legs, the thermal/compression therapy wrap can be worn anywhere thermal/compression therapy is needed. For example, if a patient has had knee surgery, the thermal/compression therapy wrap can be worn around the healing knee to reduce swelling, while the DVT cuffs are worn close to the patient's ankles to help keep blood circulating within the patient over prolonged periods of rest and non-movement. This application can be performed immediately after surgery at the hospital and/or later when the patient returns home.

As discussed in detail below, in one embodiment, the pump pressurizes a reservoir that is used in turn to pressurize the DVT cuffs and the thermal/compression therapy wrap. Alternatively, one or more pump(s) are used to directly pressurize the DVT cuffs and the thermal/compression therapy wrap. In either case, pressurized air is used in each pneumatic line with a control valve, bleed valve and pressure sensor in one embodiment to achieve the pressure profile stored in and executed by the electronics.

In one embodiment, each DVT cuff is attached to a single pneumatic line, which is advantageous for cost, weight and simplicity reasons. Each cuff includes two inflatable chambers that are fluidly separated from each other. Each DVT pneumatic line extends from the housing of the system and splits at the DVT cuff into a first line segment and a second line segment. The first line segment extends to a distal air chamber (distal on leg relative to the heart when the cuff is properly donned), which is pressurized first when the pneumatic line is pressurized. The second line segment extends to a proximal air chamber (proximal on leg relative to the heart when the cuff is properly donned), which is pressurized second when the pneumatic line is pressurized.

The delay in pressurizing the second or proximal air chamber is caused by a flow restricting structure that is placed in the second line segment or in a passageway in the cuff leading from the second line segment to the second air chamber. For example, the first and second line segments can split at a "Y" connector. The "Y" connector can be outside the cuff, inside the cuff or pathway outside and pathway inside the cuff. The flow restricting structure can be a narrowed and/or torturous passageway formed or placed in a second line segment portion of the "Y" connector. Or, the flow restricting structure can be a pneumatically operated valve check valve formed or placed in a second line segment portion of the "Y" connector. Here, pressure has to build to a certain point before the check valve opens, delaying pressurization of the proximal chamber. A return check valve can be provided in addition, allowing the proximal chamber to deflate when desired. The flow restricting structure is further alternatively a torturous and/or narrowed passageway in the cuff leading to the proximal chamber. The cuff can be sealed together from two plastic sheets to form the chambers. The same process can form baffles that extend part way across the cuff passageway and alternate, forcing air to move in a serpentine manner through a narrowed cross-section. Still further alternatively, the flow restricting structure can be any combination of the structures just described.

It is accordingly an advantage of the present disclosure to provide a pneumatic pressure therapy system that is relatively low cost.

It is another advantage of the present disclosure to provide a pneumatic pressure therapy system that is relatively easy to use.

It is a further advantage of the present disclosure to provide a pneumatic pressure therapy system that includes both DVT and thermal/compression therapy.

It is yet another advantage of the present disclosure to provide a pneumatic pressure therapy system that flexibly allows for different pressure profiles, which may be provided as selections for the user.

Additional features and advantages are described herein, and will be apparent from the following Detailed Description and the figures.

DETAILED DESCRIPTION

Pneumatic Circuit

Figure 1:
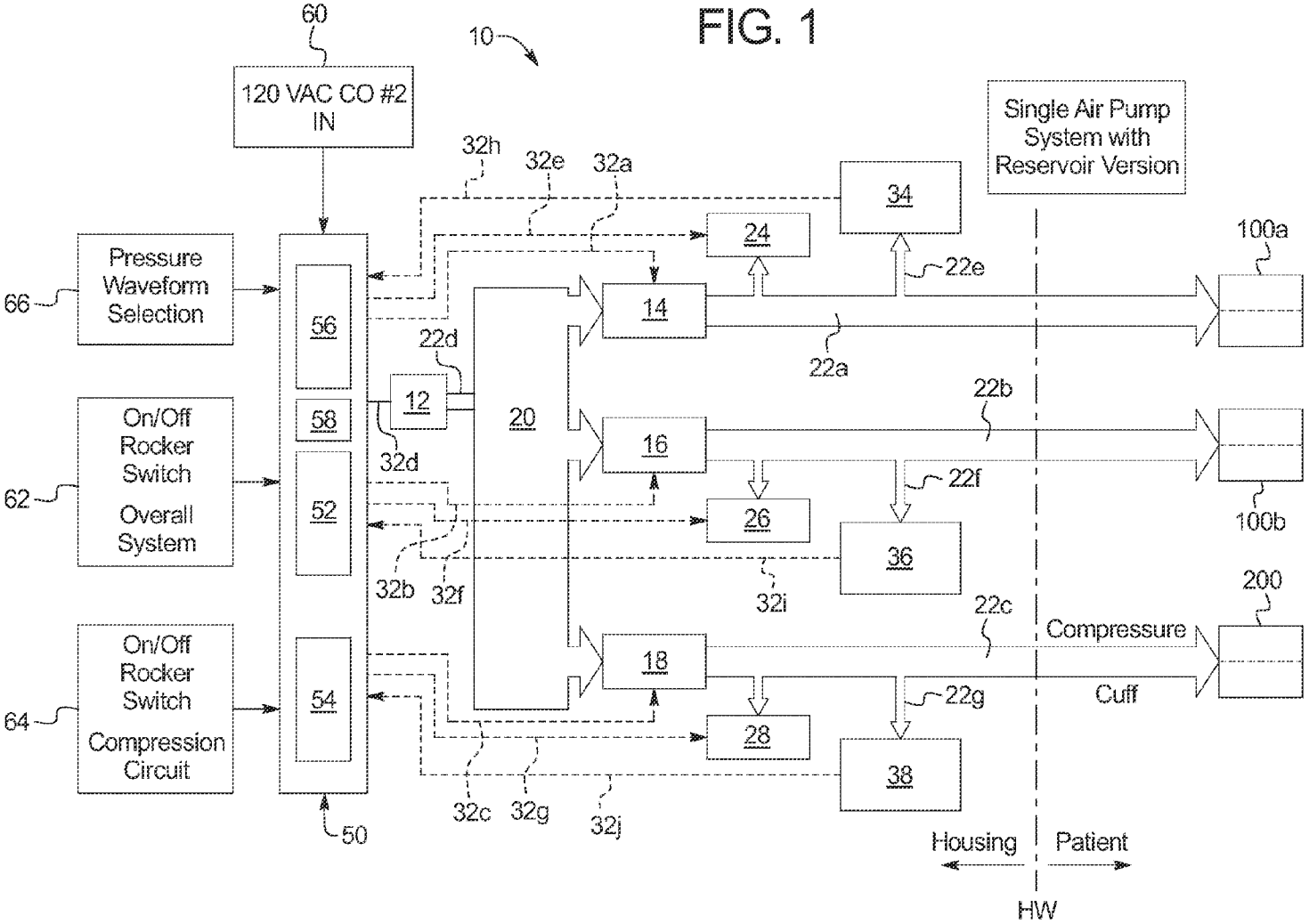
FIG. 1 is a schematic view of one embodiment of a pneumatic circuit and system control of the present disclosure.

Referring now to the drawings and in particular to FIG. 1, a pneumatic system for operating a plurality of DVT cuffs and a thermal/compression therapy wrap is illustrated by system 10. System 10 may employ any of several different pneumatic circuit alternatives. For example, system 10 may include: (i) a single pump driving multiple DVT cuff chambers and the thermal/compression therapy wrap without a reservoir; (ii) a single pump driving multiple DVT cuff chambers and the thermal/compression therapy wrap with a reservoir (shown schematically below); (iii) a first pump driving multiple DVT cuff chambers and a second pump driving the thermal/compression therapy wrap; and (iv) a pump dedicated to each DVT cuff chamber and a pump dedicated to the thermal/compression therapy wrap. System 10 may alternatively include only a single DVT cuff, a single DVT cuff and thermal/compression therapy wrap or more than two DVT cuffs with or without a wrap driven via any one of (i) to (iv).

For ease of illustration, alternative (ii) has been chosen for illustration and description, as illustrated by system 10 in FIG. 1. It should be appreciated however that the pneumatic sequencing described below may be used with any of system alternatives (i) to (iv). Also, any of the DVT cuffs and/or thermal/compression therapy wraps discussed herein may be used with any of the system types (i) to (iv).

System 10 includes an air pump 12, for example, an Oken Sieko air pump, part number P54E01R. Pump 12 is powered via electronics 50, which can output alternating current ("AC", e.g., 110/120 or 230/240 VAC) or direct current ("DC", e.g., 24 VDC) to pump 12 and/or to the valves as described below. Electronics 50 can include one or more processor 52 and memory 54. Electronics 50 may also include a power supply 56, e.g., for converting AC line voltage 60 to DC voltage for powering pump 12 and the associated valves and/or pressure sensors. Electronics 50 also include input/output switching 58 that receives commands from processor 52 and switches electrical contacts to either allow or disallow power to be delivered to the pumps, valves and pressure sensors.

Pump 12 pumps to an air reservoir 20 in the illustrated embodiment, which can be a plastic or metal container sized and arranged to hold the maximum pressure that can be supplied via pneumatic line 22*d* by pump 12, plus an engineering factor of safety, e.g., 1.5 to 2.0 times the maximum pump output. Air reservoir 20 holds pressurized air supplied to pneumatic lines 22*a*, 22*b* and 22*c*, which in turn feeds pressurized air to left DVT cuff 100*a*, right DVT cuff 100*b* and thermal/compression therapy wrap 200, respectively. Pneumatic lines 22*a*, 22*b* and 22*c* are controllably pressurized by control valves 14, 16 and 18, respectively, which (i) open to allow the pneumatic lines 22*a*, 22*b* or 22*c* to become pressurized and (ii) close to prevent further pressurization of the line. When pneumatic lines 22*a*, 22*b*, 22*c* are pressurized, left cuff 100*a*, right cuff 100*b* and thermal/compression wrap 200 are likewise respectively pressurized (e.g., according to staggered pressure chamber structures discussed below).

Pneumatic lines 22*a*, 22*b* and 22*c* are each fluidly connected to a respective bleed valve 24, 26 and 28. Control valves and bleed valves may be, for example, valves provided by Koganei, part number GA010HE1. Bleed valves 24, 26 and 28 enable pneumatic lines 22*a*, 22*b* and 22*c* and respective cuffs 100*a*, 100*b* and 200 to be depressurized. Depressurization of the lines and cuffs can be to atmospheric pressure. Alternatively, depressurization is to a modulated residual pressure, e.g., at slightly above zero gauge pressure. Thus with control valves 14, 16 and 18 closed, if bleed valves 24, 26 and 28 are opened, pressure in the respective lines and cuff, or wrap, is bled to zero gauge pressure or a slightly higher residual pressure.

Pneumatic lines 22*e*, 22*f* and 22*g* extend off of pneumatic lines 22*a*, 22*b* and 22*c*, respectively, and feed respective pressure sensors 34, 36 and 38. Pressure sensors 34, 36 and 38 send pressure signals back to electronics 50, enabling (i) feedback to electronics 50 so that respective cuffs 100*a*, 100*b* and wrap 200 can be initially inflated to a desired pressure, and (ii) feedback to electronics 50 so that pressure in the cuffs and wrap can be maintained by opening control valves 14, 16 or 18 to add pressure if needed or opening bleed valves 24, 26 and 28 to relieve pressure if needed. Processing 52 and memory 54 are programmed to receive the pressure signals, decide what action if any is needed, and operate input/output switches 56 to control the appropriate valve. As discussed in more detail below, electronics 50 and pump 12 operate to replenish reservoir 20 as needed so that the pressurization of cuffs 100*a* and 100*b* and wrap 200 can be performed repeatedly, as long as it is desired.

In FIG. 1, all electrical power and signal lines are shown dashed. Power lines (AC or DC) 32*a*, 32*b*, 32*c*, 32*d*, 32*e*, 32*f* and 32*g* n from input/out switches 56 respectively to control valve 14, control valve 16, control valve 18, pump 12, bleed valve 24, bleed valve 26 and bleed valve 28. Signal lines 32*h*, 32*i* and 32*j* (e.g., 0 to 5VDC or 4 to 20 mA) run from pressure sensors 34, 36 or 38, respectively, to input device 56, which can include an A/D converter and other electronics needed to convert the pressure signal into digitized data used by processor 52 to make any necessary control response.

As shown in FIG. 1 of the illustrated embodiment, control valves 14, 16 and 18 are normally closed valves as are bleed valves 24, 26 and 28. That is, upon loss of power, the valves will fail closed. In an alternative embodiment, any one or more of valves 14, 16, 18, 24, 26 and 28 are normally open valves that close when energized. In such case, electronics 50 sends power to a valve when it is desired to keep the valve closed. Upon a power loss, pump 12 stops the pumping of air regardless of whether the control and bleed valves are normally open or normally closed.

Bleed valves 24, 26 and 28 enable left cuff 100*a*, right cuff 100*b* and compression wrap 200 lines 22*a*, 22*b* and 22*c* to vent to atmosphere, that is, relieve pressure in the lines. Bleed valves 24, 26 and 28 can be adjustably modulated to leave a residual pressure in their respective lines 22*a*, 22*b* and 22*c*. It is contemplated in one embodiment to set bleed valves 24, 26, and 28 to leave about 10% of the maximum pressure (e.g., from 1.0 psig down to 0.1 psig) when the lines are depressurized. Valves 14, 16, 24 and 26 control the DVT therapy, while valves 18 and 28 control the thermal/compression therapy.

In the illustrated embodiment, a single air pump 12 supplies a reservoir, which will have a maximum pressure output for example of about eight psig. Reservoir 20 will supply each of left cuff 100*a*, right cuff 100*b* and compression wrap 200 to achieve the desired pressure waveform rise times discussed below. Reservoir 20 also dampens the pulsatility of the output of air pump 12 and thereby smoothes the pressure changes in the below—discussed pressure waveforms. Further, reservoir 20 lessens the frequency that air pump 50 has to be started and stopped, thereby extending the life of the air pump 12.

Air pump 12 fills reservoir 20 as required, periodically over any of the pressure cycles discussed herein. Reservoir 20 can have a pressure sensor (not illustrated) that feeds back a pressure signal to the electronics 50, which uses the signal to control pump 12 to maintain pressure within the reservoir. Alternatively, the electronics 50 may operate with a high pressure switch (not illustrated) to detect a maximum preset pressure for reservoir 20 and shut the air pump 12 off for a preset period or until a second, low pressure switch signals to turn pump 12 back on to regulate pressure in the reservoir 20. Further alternatively, software employed by processing 52 and memory 54 of electronics 50 may anticipate the pressure of the reservoir 20 via knowledge of the operational pressure cycle and shut the air pump 50 off in an open loop fashion to control the pressure of reservoir 20. In any of these scenarios, air pump 12 maintains the reservoir 20 in one embodiment at about two to about eight psig. The relatively low reservoir pressure allows left cuff 100*a*, right cuff 100*b* and compression wrap 200 lines 22*a*, 22*b* and 22*c* to operate respectively without relief valve(s). However, a relief valve that opens if the pressure in a respective one or more lines 22*a*, 22*b* and 22*c* increases too much could be added if desired to any one or all of those lines. In such a case, a higher pressure in reservoir 20 can be maintained.

Left cuff 100*a* and right cuff 100*b* are two separate cuffs (e.g., one for the patient's left leg and one for the patient's right leg), each having, e.g., two chambers, a distal chamber (pressurized first) and a proximal chamber (pressurized shortly afterward). Thus in the illustrated embodiment, each of the left and right cuffs 100*a* and 100*b* is a single line cuff and is operated as discussed next.

In one DVT waveform embodiment, air pump 12 is energized at time T-0. With bleed valve 26 closed (de-energized), control valve 14 is opened (energized) immediately after time T-0, at time T-1, and stays open until pressure sensor 34 reads about 0.8 psig, at which time control valve 14 is closed (de-energized). Control valve 14 is then toggled on and off, using pressure feedback from pressure sensor 34, so that the 0.8 psig pressure is maintained in the left cuff line 22*a* and the left cuff 100*a* for a specified duration, e.g., six seconds, the end of which corresponds to a time T-2. Control valve 14 is then closed (de-energized) for the remainder of the cycle, while bleed valve 24 is opened (energized) for the remainder of the cycle time, e.g., until sixty seconds after time T-0, to relieve pressure in the left cuff line 100*a* to a non-zero pressure (e.g., 0.1 psig) set by modulating bleed valve 24. Thus in one implementation, the opening of bleed valve 24 relieves pressure in the left cuff line 22*a* and left cuff 100*a* to about 0.1 psig during the remainder of time from T-2 until sixty seconds after time T-0. A relief valve (not illustrated), if provided in left cuff line 22*a*, would be set at some pressure above one psig.

Continuing with the DVT therapy, while bleed valve 26 is closed (de-energized), control valve 16 is opened (energized) at time T-2, allowing right cuff line 22*b* and the right cuff 100*b* to become pressurized at the time when the left cuff line 22*a* and the left cuff 100*a* are vented to their residual pressure as just described. Control valve 16 is then toggled on and off, using pressure feedback from pressure sensor 36, so that about 0.8 psig pressure is maintained in the right cuff line 22*b* and the right cuff 100*b* for a specified period, e.g., six seconds, the end of which corresponds to time T-3. Control Valve 16 is then closed (de-energized), while bleed valve 26 is opened (energized) for the remainder of the time until time T-2 occurs in the next cycle, the next cycle beginning sixty seconds after time T-0. The opening of bleed valve 26 relieves pressure in the right cuff line 22*b* and the right cuff 100*b*, again to about 0.1 psig, during the remainder of time until control valve 26 is next opened (energized) and bleed valve 26 is closed (de-energized). A relief valve (not illustrated), if provided in right cuff line 22*b*, would again be set at some pressure above one psig.

Figure 2A:
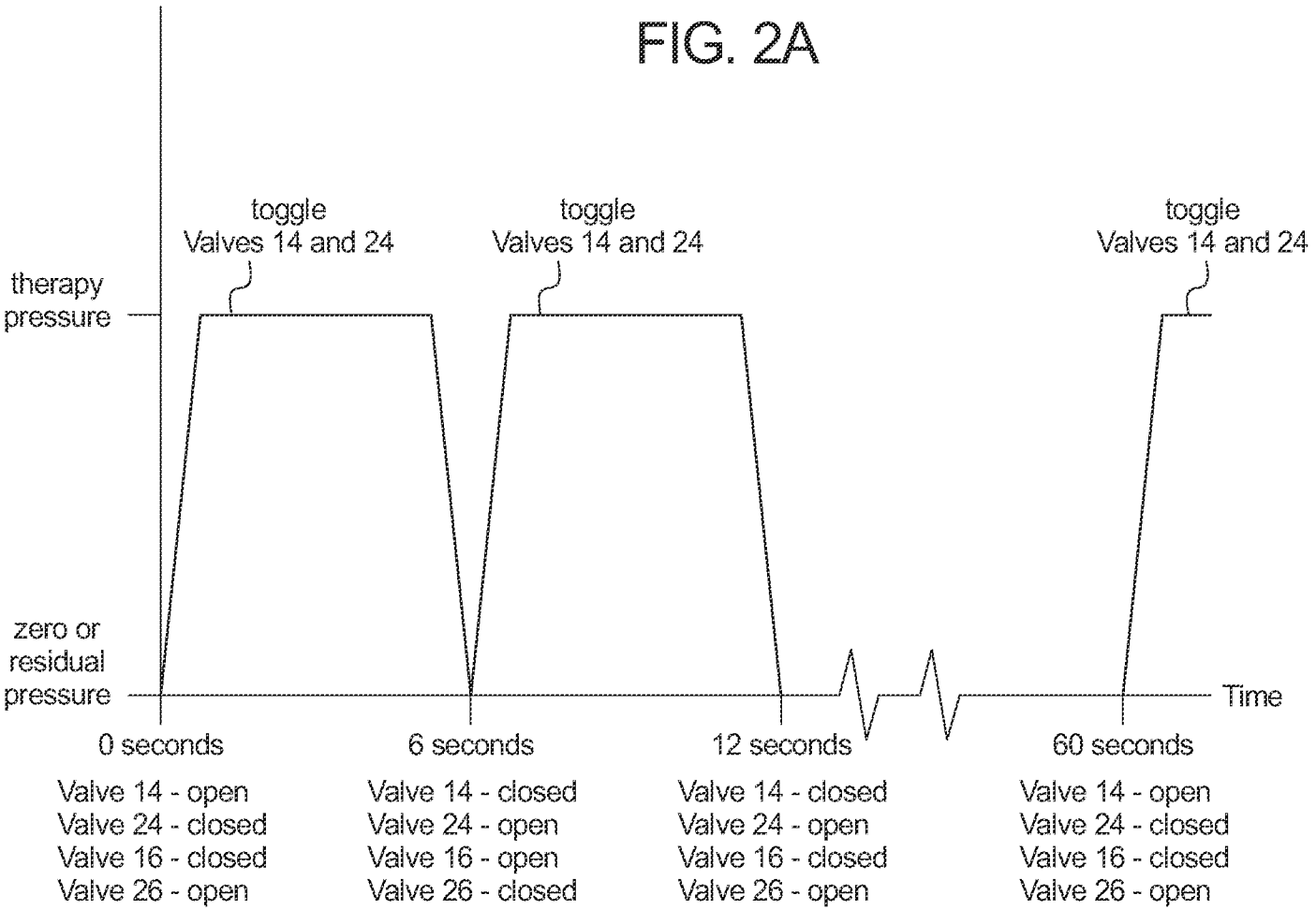
FIG. 2A is an example pressure waveform provided by the electronics, pneumatic circuit and DVT cuffs of the present disclosure.

The DVT sequence just described is illustrated graphically in FIG. 2A. Over a minute cycle, the sequence proceeds, e.g.: (i) left cuff 100*a* pressurized, right cuff 100*b* maintained at residual pressure (zero seconds to six seconds), (ii) left cuff 100*a* maintained at residual pressure, right cuff 100*b* pressurized (six seconds to twelve seconds), and then (iii) left cuff 100*a* and right cuff 100*b* maintained at residual pressure (twelve seconds to sixty seconds). The sequence just described is then repeated as many times as desired. The offsetting of the pressurizing of left cuff 100*a* and right cuff 100*b* is done so that pump 12 and reservoir 20 can be sized to only need the capacity to fill one of the DVT cuffs (plus thermal/compression therapy wrap 200 if done simultaneously) at any given time over the cycle. The sequence can be varied such that pressurization times are more or less than six seconds. Left cuff 100*a* and right cuff 100*b* can be pressurized for the same or different durations. Left cuff 100*a* and/or right cuff 100*b* can be pressurized one or more times over a given cycle of the sequence. Each cycle of the sequence can be the same. Or, different cycles of the sequence can vary. Processing 52 and memory 54 of electronics 50 can be programmed to handle any of these alternatives.

Each DVT cuff 100*a* and 100*b* includes at least two chambers (dotted line in FIG. 1). As described in more detail below, cuffs 100*a* and 100*b* are configured to stagger the pressurization of each cuff. Thus for the, e.g., six seconds of inflation, the pressurization of the chambers of each cuff is staggered to provide a desired sequential compression of the patient's inner veins.

Figure 2B:
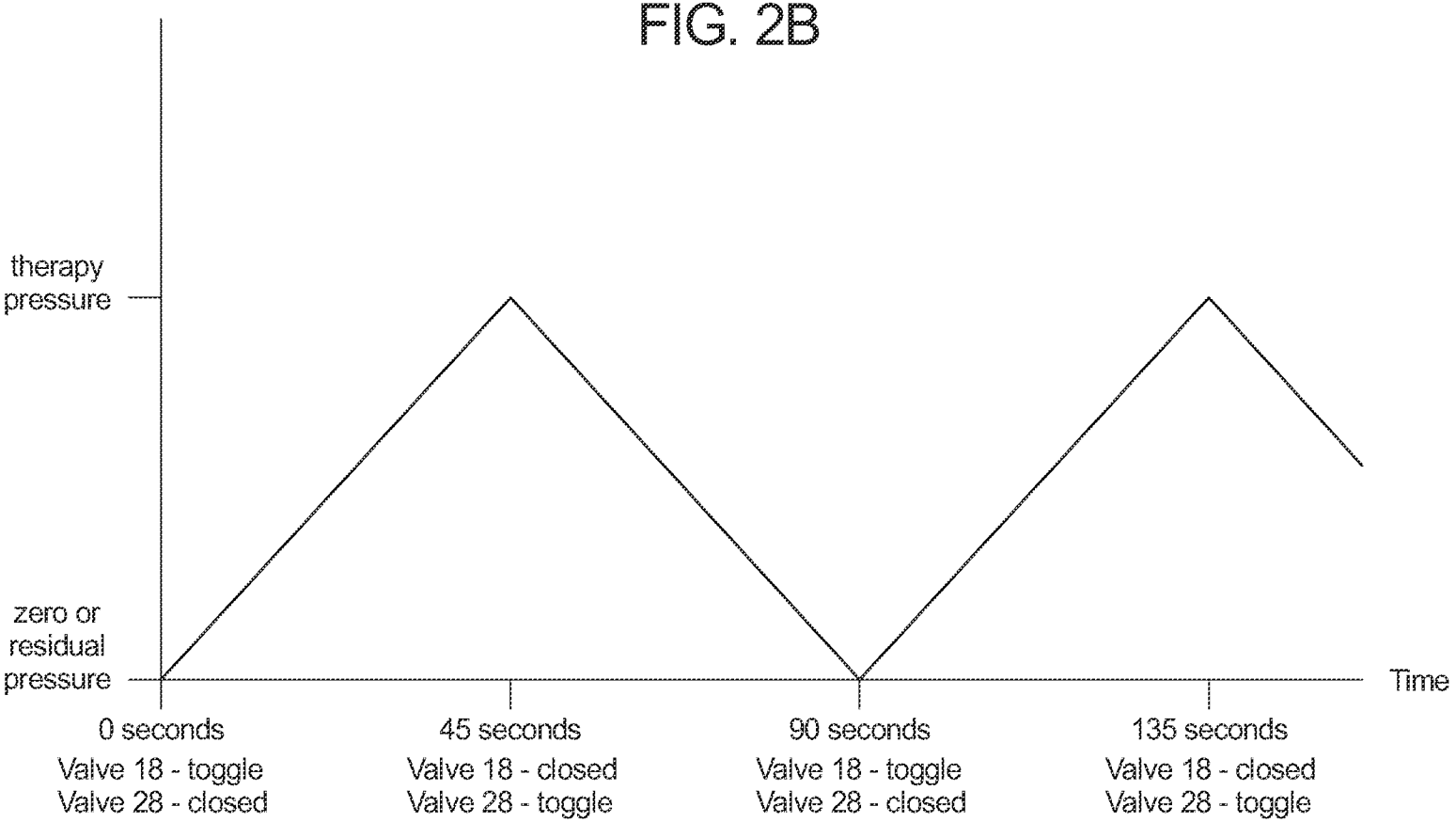
FIG. 2B is an example pressure waveform provided by the electronics, pneumatic circuit and thermal/compression therapy wrap of the present disclosure.

For the thermal/compression therapy, with bleed valve 18 closed (de-energized), control valve 28 is opened (energized), allowing the pressure in the compression cuff line 22*e* and the compression cuff 200 to build in a linear fashion to about 0.8 psig over forty-five seconds. At the forty-five second mark, control valve 18 is closed (de-energized) and bleed valve 28 is opened (energized) to atmosphere to allow the pressure in the compression cuff line 22*c* and the compression cuff 200 to ramp down in a linear fashion over the next forty-five seconds to a fraction of the 0.8 psig maximum, e.g., to about 0.1 psig. The ninety second sequence is then repeated as illustrated in FIG. 2B. Pressure feedback via pressure sensor 38 is used to control the triangular waveform illustrated in FIG. 2B.

In one embodiment, the control by electronics 50 of the DVT and thermal/compression therapies is completely separated. Either therapy can operate while the other therapy is performed or not performed. Both therapies can be run simultaneously, but if so, the sixty second cycle of the DVT therapy is completely independent in one embodiment, of the ninety second cycle of the thermal/compression therapy. The DVT Therapy can be started at the same time as, or at any time after, the thermal/compression therapy is started and vice versa.

The ramping up of pressure in DVT left cuff 100*a* is achieved using pressure feedback from pressure sensor 34, control valve 14 and the electronics 50. The ramping up of pressure in the DVT right cuff 100*b* is achieved using pressure feedback from pressure sensor 36, control valve 26 and the electronics 50. The linear ramping up of pressure in the thermal/compression therapy wrap 200 is achieved using pressure feedback from pressure sensor 38, control valve 18 and electronics 50 to modulate a pressure profile to build to 0.8 psig linearly over forty-five seconds. Likewise, the linear ramping down of pressure in thermal therapy/compression wrap 200 is achieved using pressure feedback from the same pressure sensor 38, bleed valve 28 and electronics 50 to modulate a pressure profile via the bleed valve to relieve from 0.8 psig down to close to atmosphere over the following forty-five seconds. The valve states for the DVT and thermal/compression therapies are shown respectively in FIGS. 2A and 2B.

Figure 3:
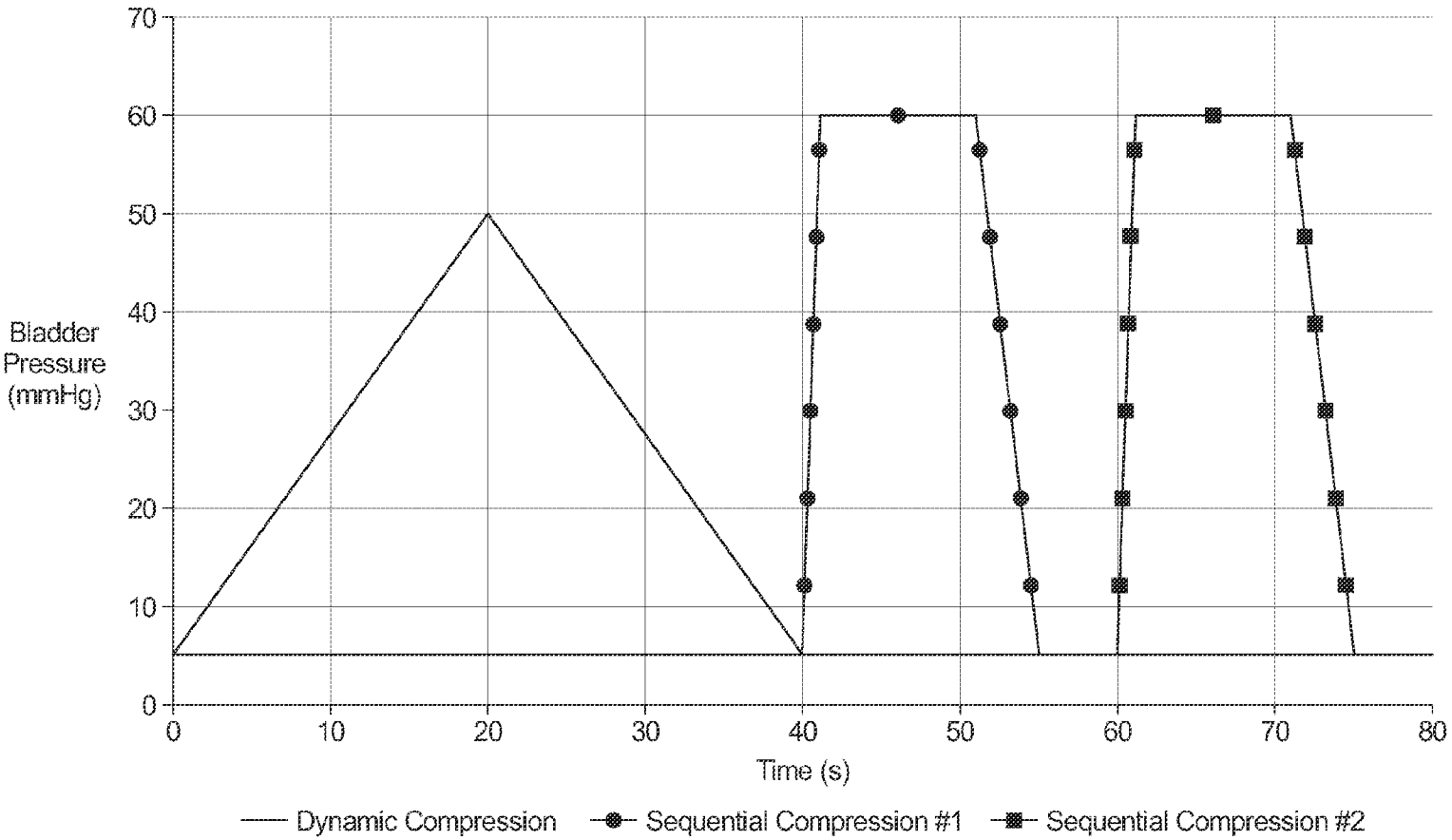
FIG. 3 is an example pressure waveform provided by the electronics, pneumatic circuit, DVT cuffs and thermal/compression therapy wrap of the present disclosure.

Referring now to FIG. 3, in an alternative embodiment the DVT and thermal/compression therapy waveforms are linked or synchronized. In the illustrated embodiment, the three waveforms do not overlap, enabling the pump to be sized so that it only has to pressurize (directly or via reservoir 20) one cuff or wrap at a time. In FIG. 3, the thermal/compression therapy waveform is shown in solid line, the first DVT cuff 100*a* waveform is shown with lines including circles, while the second DVT cuff 100*b* waveform is shown with lines including squares. Each waveform is shown depressurized to a residual pressure, however, any of the waveforms could alternatively be depressurized to atmospheric pressure.

The overall cycle consumes about seventy-five seconds. At the end of seventy-five seconds, the cycle of FIG. 3 is repeated. If DVT therapy is not used, the thermal/compression therapy waveform does not change in one embodiment, such that system 10 applies no pressure over the last thirty-five seconds of the cycle. Likewise, if the thermal/compression therapy is not used, the DVT therapy waveforms do not change in one embodiment, such that system 10 applies no pressure over the first forty seconds of the cycle. Alternatively, electronics 50 can be programmed to modify one or both of the DVT and/or thermal/compression waveforms if the other type of waveform is not being used.

FIG. 3 also illustrates that there can be a non-pressurization break between the waveforms of DVT cuffs 100*a* and 100*b*. The valve sequencing and use of pressure feedback descried above for the waveforms of FIGS. 1, 2A and 2B can also be used to produce the waveforms of the combined therapy cycle of FIG. 3.

Any of the waveforms in FIGS. 2A, 2B and 3 can each be rectangular, trapezoidal, rhomboidal, square, triangular, linear, nonlinear, stepped, constant, interrupted, or any desired combination thereof. The DVT waveforms can be triangular instead of stepped as is illustrated in FIG. 3. The thermal/compression therapy waveform can be rectangular, trapezoidal, rhomboidal or square instead of triangular as is illustrated in FIG. 3.

While not illustrated in FIG. 1, a small, fixed bleed valve may be provided with each DVT cuff 100*a* and 100*b* or with the base unit pneumatics to allow system 10 to deflate eventually when power is removed. In FIG. 1, components to the left of hardware line HW are located inside or are mounted on a housing (except for house voltage supply 60). Components to the right of hardware line HW are located outside of the housing and extend to the patient.

The housing in FIG. 1 houses electronics 50, which receive standard 120 VAC, 60 HZ, AC power. The housing in the illustrated embodiment provides two switches, switch 62 for the overall system, including the DVT valves, and a second switch 64 for the thermal/compression therapy valves, allowing for independent on/off control of power to the DVT and the thermal/compression therapy valves. Switches 62 and 64 can be maintained switches. Thus in one embodiment, to run just the DVT therapy, the user presses or toggles switch 62 only. To run just the thermal/compression therapy, the user presses or toggles both switches 62 and 64 in one embodiment. Alternatively, the user activates only switch 64. To run both therapies, the user activates both switches in the illustrated embodiment. The pressure waveform used for either or both the DVT cuffs and the thermal/compression wrap can be selected by the patient from a plurality of stored waveforms via a pressure waveform selection device 66 (e.g., a pushbutton dedicated to each waveform or a scroll and select input). Pressure waveform selection device 66 communicates with input/output switching 62 and in turn with processing 52 and memory 54 of electronics 50.

Valves 14 to 28 are all electrically operated solenoid valves in the illustrated embodiment, which electronics 50 operates to open and close as discussed above. If relief valves are provided, they can be pressure operated valves that open upon a mechanically adjusted bursting pressure and therefore do not require electronic control. As discussed, the electronics 50 receives signal feedback from pressure sensors 34, 36 and 38, which are used as feedback to control valves 14, 16 and 18, respectively. Pressure sensor 38 is also used as feedback to control bleed valve 28 for the linear deflection of thermal/compression wrap 200.

DVT Cuffs

Referring now to FIGS. 4 to 9, multiple DVT cuff alternatives for DVT cuffs 100*a* and 100*b* (referred hereafter generally as cuff 100) are illustrated. Each option involves a single line DVT cuff. Cuffs 100 each use two air chambers 110 and 120 to provide intermittent, sequential compression to the lower leg or calf for DVT therapy. Air chambers 110 and 120 are arranged so that the first chamber 110 to inflate is distal to the heart along the limb or leg. Very shortly afterward, the second (proximal) chamber 120 inflates.

With any of the three options, cuff 100 is made using two flat sheets of material, such as thermoplastic polyurethane ("TPU") or vinyl sheets, that are heat sealed, sonically sealed, and or solvent bonded, along their outer peripheries 112 to form a unit and along inner seal lines 114 to form the two proximal and distal air chambers 110 and 120 and attachment flaps 102 and 104. Flaps 102 and 104 have mating hook or pile closures 106 and 108, respectively. For each of the three options, a single line or tube 22 (any of tubes 22*a*, 22*b* or 22*c*) leads to the cuff assembly for air to enter the distal 110 and then the proximal 120 chambers of the cuff 100. Air also leaves the cuffs via the single line. A "Y" connector 130 splits the single line air pathway 22 near cuff 100 into two small tubing or line segments 122 and 124, including a proximal tubing segment 124 that attaches to and seals to the proximal air chamber 120 and a distal tubing segment 122 that attaches to and seals to the distal air chamber 110.

Figure 4:
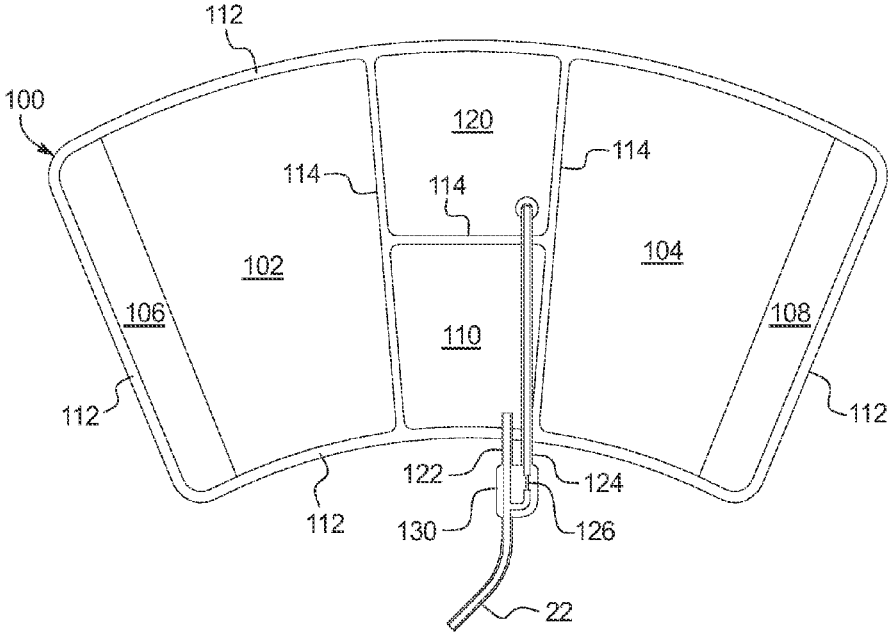
FIG. 4 is a plan view of one embodiment of a single line DVT cuff having a flow restricting structure leading to a proximal chamber of the cuff.
Figure 5:
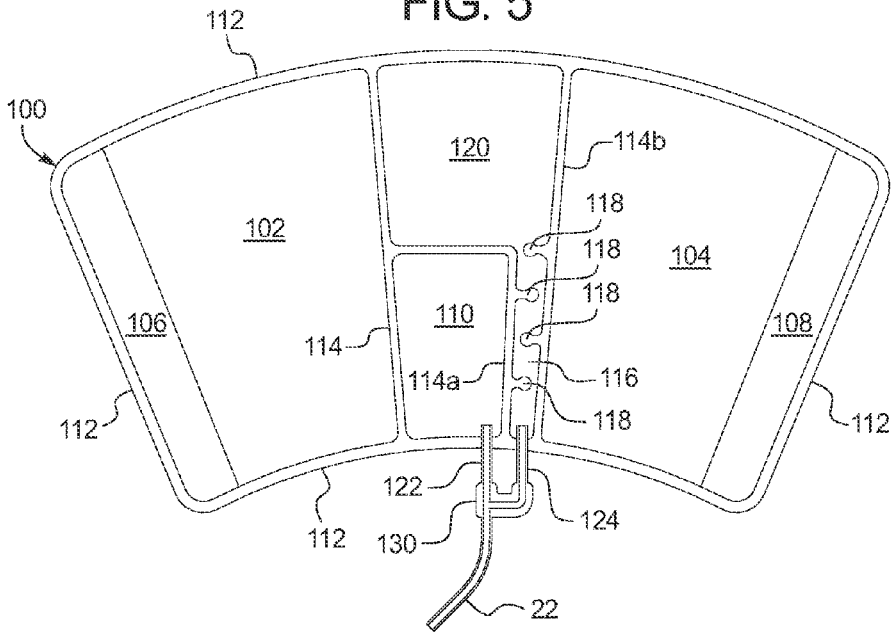
FIG. 5 is a plan view of a second embodiment of a single line DVT cuff having a flow restricting structure leading to a proximal chamber of the cuff.
Figure 6A:
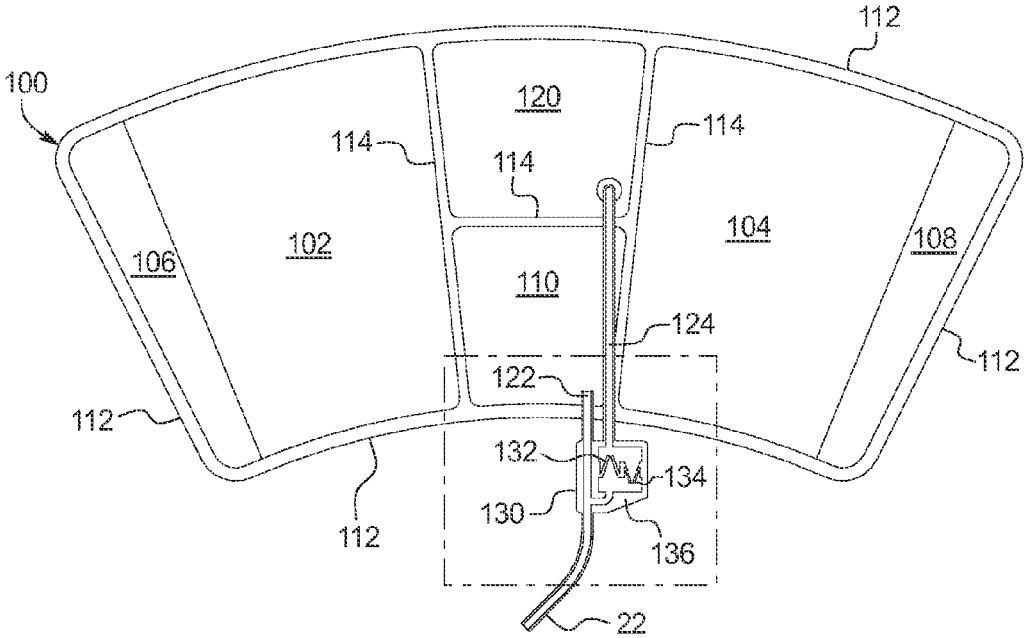
FIG. 6A is a plan view of a third embodiment of a single line DVT cuff having a flow restricting structure leading to a proximal chamber of the cuff.

The three alternatives of FIGS. 4, 5 and 6A/6B involve three different structures that allow distal air chamber 110 (lower on leg) to be inflated before the proximal air chamber 120 (closer to patient's heart). Each of the structures is in one embodiment a mechanical structure that blocks air flow in some manner. Under each of the three alternatives in the illustrated embodiment, air from distal chamber 110 never flows to proximal chamber 120 and air from the proximal chamber 120 never flows to the distal chamber 110.

In FIG. 4, a restrictor 126 is placed downstream of the "Y" connector 130 split in the second inflated or proximal tube segment 124. When the, e.g., 0.8 psig, air (described above) hits the distal and proximal tube segments 122 and 124, the pressurized air takes longer to migrate through restrictor 126 and the proximal tube segment 124, causing a delay in the inflation of proximal chamber relative 120 to distal chamber 110.

In FIG. 5, a tortuous pathway 116 is placed downstream of the "Y" connector 130 split, located between seal lines 114*a* and 114*b*, and leading to the second or proximal chamber 120. Tortuous pathway 116 is made tortuous via the provision of alternating seal baffles 118 (sealed via any method above)

which extend part way, but not all the way between seal lines 114*a* and 114*b*. Tortuous pathway 116 forces pressurized air to flow around the free ends of baffles 118, thus delaying pressurized air from reaching second inflated, proximal chamber 120. Again, when the 0.8 psig air (described above) after the tubing split 130 hits cuff 100, the pressurized air takes longer to migrate through the tortuous path 116 to the proximal chamber 120, causing a delay in the inflation of the proximal (closer to heart) chamber 120 relative to the distal (closer to foot) chamber 110.

Figure 6B:
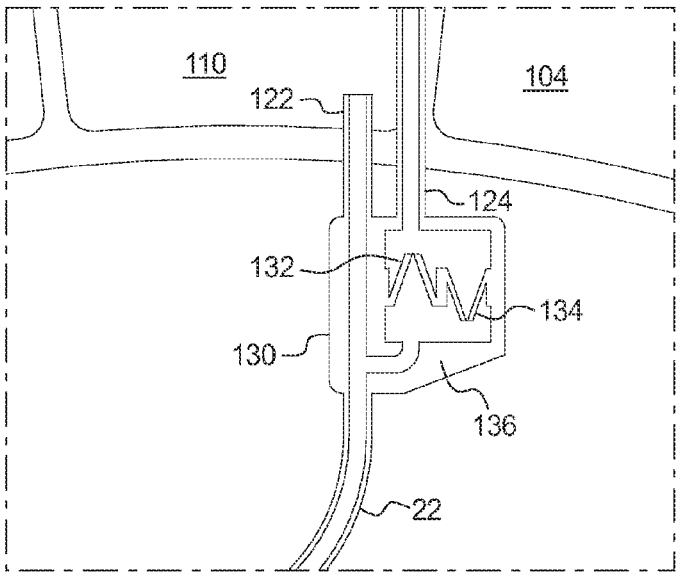
FIG. 6B is a plan view of an enlarged portion of FIG. 6A, showing a pair of check valves in more detail.

In FIGS. 6A and 6B, a pair of check valves (e.g., duckbilled check valves) 132 and 134 is placed downstream of the "Y" connector split 130, in a valve chamber 136 for the second or proximal tube segment 124. Inlet check valve 132 allows air from the proximal tube segment 124 into the second, proximal chamber 120 upon inflation when a minimum or cracking pressure (e.g., 0.5 psig) is attained upstream of check valve 132 in chamber 136. Check valve 132 has a fixed cracking pressure (e.g., 0.5 psig) to serve this function. Outlet check valve 134 faces the opposing direction from inlet check valve 132 and allows air to flow from the second inflated, proximal chamber 120, through chamber 136, back into the single inflation line 22 and to atmosphere (or residual pressure) upon deflation. Check valve 134 can be provided with a cracking pressure slightly above zero or be zero to serve the deflation this function.

Line 22 maintains pressure over the DVT inflation period, e.g., the six seconds out of a minute as described in connection with FIG. 2A above. During the inflation period, it should be appreciated that the same pressure resides on both sides of outlet check valve 134. Thus there is no pressure gradient to open outlet check valve 134 during or after inflation. When the appropriate bleed valve 24 or 26 is opened, however, pressure in line 22 decreases towards zero or residual pressure. The higher pressure residing in proximal chamber 120 and the decreased pressure in line 22 cause a gradient that forces outlet chamber 134 open to then relieve the proximal chamber pressure to atmosphere or a residual pressure.

Because first check valve 132 assures that there is a pressure differential during inflation, the resulting cuff 100 has a "gradient pressure", in which the distal air chamber 110 is inflated to a higher pressure than the proximal chamber 120. This type of pressure gradient has been shown to be therapeutically beneficial. Appropriately engineered duckbill valves are well-suited because of their low cost and simplicity, but other types of check valves could be used alternatively. As shown in FIG. 6B, the two check valves 132 and 134 can be integrated into one dual-function valve housing 136.

If desired, any of the flow restricting structures described in FIGS. 4, 5, 6A and 6B can be combined to form an overall flow restricting structure. The small or capillary tube restriction of FIG. 4 can be combined with the tortuous pathway (which is also narrowed and restricting). Either of those two can be combined with the check valves of FIGS. 6A and 6B. Or, all three structures can be combined. Further alternatively, restrictor 126 (FIG. 4) and/or check valves 132 and 134 (FIGS. 6A and 6B) can be provided instead in passageway 116 (FIG. 5). Or, a tortuous pathway (FIG. 5) can be provided in connector 130.

Figure 7A:
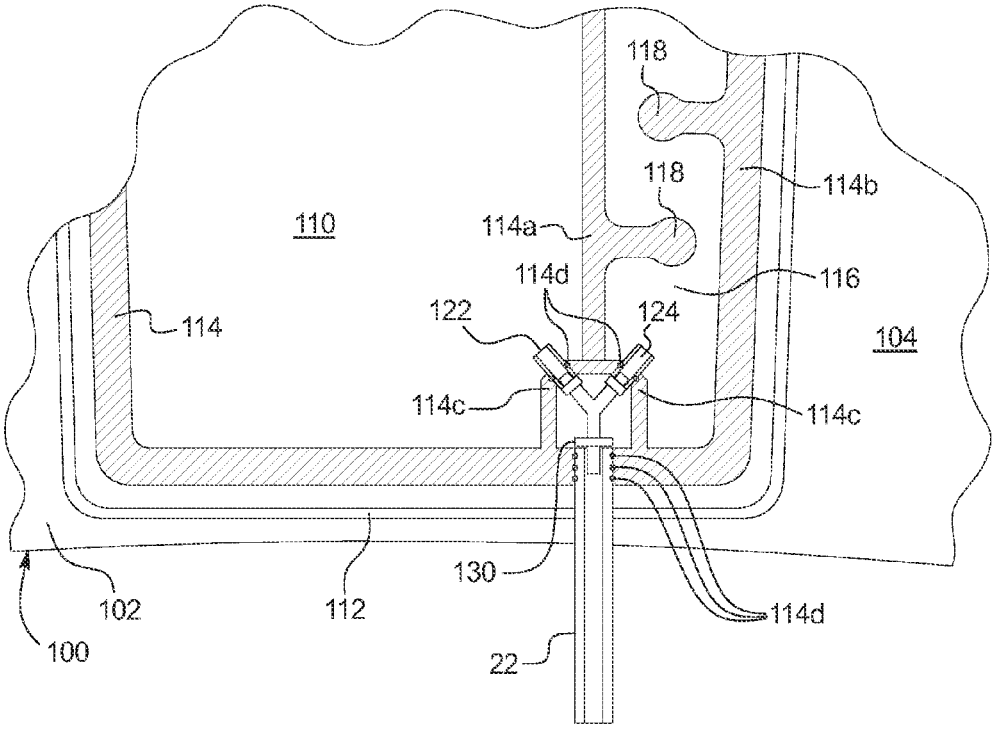
FIG. 7A is a plan view of a forth alternative embodiment for a single line DVT cuff having a flow restricting structure leading to a proximal chamber of the cuff.

Referring now to FIG. 7A, a first alternative cuff 100 configuration in which pneumatic line 22 extends into and splits inside of sealed periphery 112 is illustrated. FIG. 7A is illustrated using tortuous pathway 116, however, the alternative splitting to chambers 110 and 120 of FIG. 7 is equally applicable to the fixed restrictor of FIG. 4, the check valves of FIGS. 6A and 6B, or any combination of these three flow restricting structures.

In FIG. 7A, "Y" connector 130 is a standard "Y" tubing connector sealed to the sheets of cuff 100 along with the end of pneumatic tube 22 via a connector weld or seal 114*c* (using any technique described herein). In the illustrated embodiment, weld or seal 114*c* includes a single border welding band 114*d* extending about each of outlet branches 122 and 124 of "Y" tubing connector 130. Weld or seal 114*c* includes three border welding bands 114*d* extending about main pneumatic tube 22, which in turn can be welded or sealed (using any technique described herein) and/or mechanically pressed onto the main inlet/outlet leg of "Y" tubing connector 130. One outlet branch 122 of "Y" tubing connector 130 extends into distal chamber 110, while the other outlet branch 124 of "Y" tubing connector 130 extends into the tortuous pathway 116 leading to proximal chamber 120. In this manner, distal and proximal chambers 110 and 120 remain pneumatically separated from each other. Sequential inflation of chambers 110 and 210 occurs as described above.

Figure 7B:
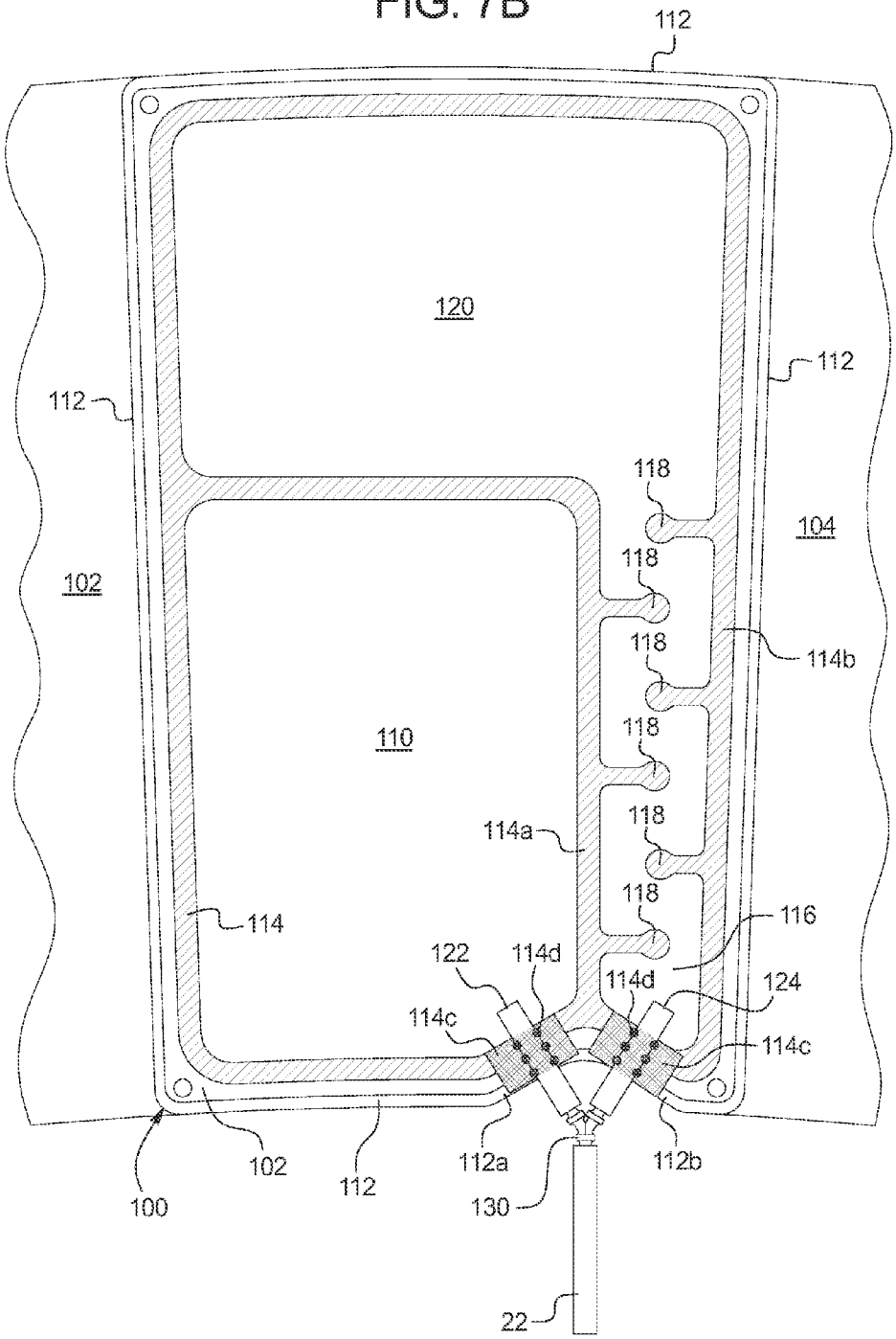
FIG. 7B is a plan view of a forth alternative embodiment for a single line DVT cuff having a flow restricting structure leading to a proximal chamber of the cuff.

Referring now to FIG. 7B, an alternative cuff 100 configuration that is similar to that of FIG. 7A, but wherein pneumatic line 22 and "Y" connector 130 reside outside of cuff 100. FIG. 7B is illustrated using tortuous pathway 116, however, FIG. 7 is equally applicable to the fixed restrictor of FIG. 4, the check valves of FIGS. 6A and 6B, or any combination of these three flow restricting structures.

In FIG. 7B, "Y" connector 130 can again be a standard "Y" tubing connector sealed to the sheets of cuff 100 via a connector weld or seal 114*c* (using any technique described herein). In the illustrated embodiment, weld or seal 114*c* includes three border welding bands 114*d* extending about each of outlet branches 122 and 124 of "Y" tubing connector 130. Main pneumatic tube 22 and branch tubes 122 and 124 can be welded or sealed (using any technique described herein) and/or mechanically pressed onto the corresponding fitting ends of "Y" tubing connector 130. In the illustrated embodiment, outer periphery 112 is angled at periphery portions 112*a* and 112*b* so that outlet branches 122 and 124 of "Y" tubing connector 130 meet cuff 100 in an at least substantially orthogonal manner. This configuration may aid in making successful welds 114*c*, including one or more border welding bands 114*d* for each outlet branch 122 and 124 of "Y" tubing connector 130.

As illustrated, one outlet branch 122 of "Y" tubing connector 130 extends into distal chamber 110, while the other outlet branch 124 of "Y" tubing connector 130 extends into the tortuous pathway 116 leading to proximal chamber 120. In this manner, distal and proximal chambers 110 and 120 remain pneumatically separated from each other. Sequential inflation of chambers 110 and 210 occurs as described above.

Figure 8:
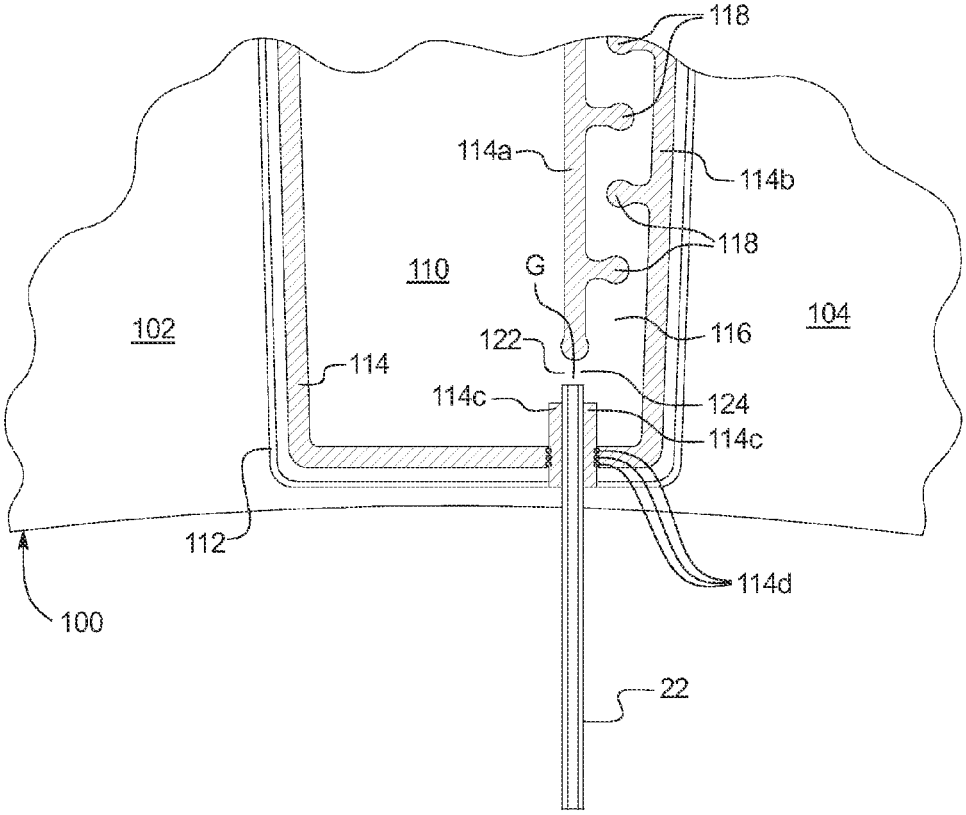
FIG. 8 is a plan view of a sixth alternative embodiment for a single line DVT cuff having a flow restricting structure leading to a proximal chamber of the cuff.

Referring now to FIG. 8, a second alternative cuff 100 configuration in which pneumatic line 22 extends into sealed periphery 112 is illustrated. FIG. 8 is again illustrated using tortuous pathway 116, however, the alternative splitting to chambers 110 and 120 of FIG. 8 is equally applicable to the fixed restrictor of FIG. 4, the check valves of FIGS. 6A and 6B, or any combination of these three flow restricting structures.

In FIG. 8, "Y" connector 130 is not provided. Instead, pneumatic tube 22 extends into cuff 100 and is sealed to the cuff sheets via a tube end seal 114*c* (using any technique described herein). In the illustrated embodiment, weld or seal 114*c* includes three border welding bands 114*d* extending about main pneumatic tube 22, which in turn can be welded or sealed (using any technique described herein) and/or mechanically pressed onto the main inlet/outlet leg of "Y" tubing connector 130. Pneumatic supply and evacuation tube 22 is located such that it terminates at a gap distance G away from an end of chamber seal 114*a* in the illustrated embodiment. The end of chamber seal 114*a* causes air entering gap G from tube 22 to split left into a distal chamber opening 122 and right into a tortuous pathway opening 124, leading to tortuous pathway 116 and proximal chamber 120. In this manner, again, distal and proximal chambers 110 and 120 remain pneumatically separated from each other, and sequential inflation of chambers 110 and 210 occurs as described above.

Figure 9:
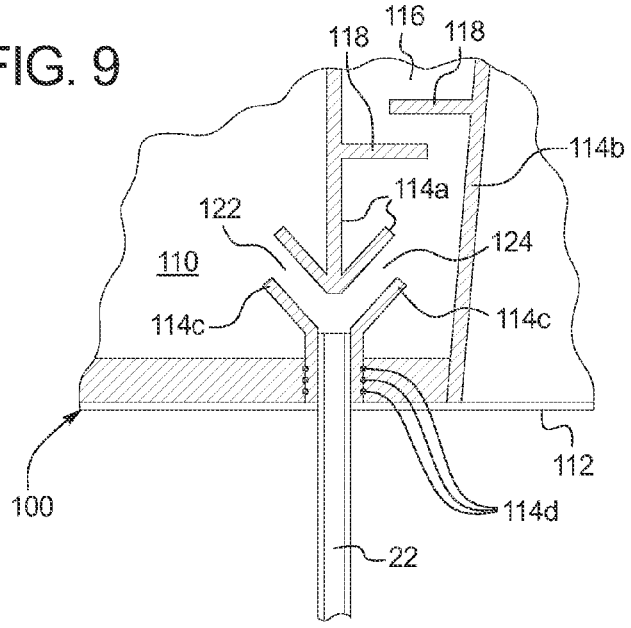
FIG. 9 is a plan view of a seventh alternative embodiment for a single line DVT cuff having a flow restricting structure leading to a proximal chamber of the cuff.

FIG. 9 is very similar to FIG. 8, except that welds or seals 114*a* and 114*c* (using any technique described herein) cooperate to form passageways 122 and 124 instead of openings 122 and 124. Seal 114*c* also captures that end of tube 22. In the illustrated embodiment, weld or seal 114*c* includes three border welding bands 114*d* extending about main pneumatic tube 22, which in turn can be welded or sealed (using any technique described herein) and/or mechanically pressed onto the main inlet/outlet leg of "Y" tubing connector 130. Passageways 122 and 124 can be angled as illustrated to provide a desired inlet and outlet flow direction. One passageway 122 extends into distal chamber 110, while the other passageway 124 extends into the tortuous pathway 116 leading to proximal chamber 120. In this manner, again, distal and proximal chambers 110 and 120 remain pneumatically separated from each other, and sequential inflation of chambers 110 and 210 occurs as described above. The FIG. 9 configuration can be used with any kind or combination of flow restricting structures discussed herein.

Thermal/Compression Therapy Wrap

Regarding the thermal/compression therapy wrap 200, alternative structures contemplated include: (i) three layers of, for example, thermoplastic polyurethane ("TPU") or vinyl, material of the same size welded together to form an inner water chamber and an outer air chamber; (ii) three layers of; for example, thermoplastic polyurethane ("TPU") or vinyl, material welded together to form an inner water chamber and an outer air chamber, but wherein the material for the outer chamber is larger so that the resulting chamber strikes a larger, better fitting circumference when wrapped around the user's limb; and (iii) two layers of, for example, thermoplastic polyurethane ("TPU") or vinyl, material welded together to form a single water chamber for thermal and compression therapies. With alternative (iii), water is pressurized and air is not used.

Alternatives (i) and (ii) employ a cold water inner wrap with a compression air bladder integrated t to the outside of it. The resulting wrap 200 is likely made from three layers of material bonded together via any technique described above. The inner chamber receives water for cooling, while the outer chamber receives pressurized air for compression. The inner and outer chambers are substantially separate in one embodiment but are joined together continuously or intermittently at the closure edges so that closing wrap 200 involves one step rather than two. In one embodiment, unlike the DVT cuff 100, the outer chamber for wrap 200 will be a single pressurized air chamber and will not have separate sub-chambers.

The water delivered to wrap 200 is via a water pump. A suitable system for providing water to wrap 200 is disclosed in commonly owned (i) U.S. patent application Ser. No. 12/973,476, entitled, "Cold Therapy Apparatus Using Heat Exchanger", filed Dec. 20, 2010, and (ii) U.S. patent application Ser. No. 13/418,857, entitled, "Cold Therapy Systems And Methods", filed Mar. 13, 2012, the entire contents of each of which are incorporated herein by reference and relied upon.

Figure 10:
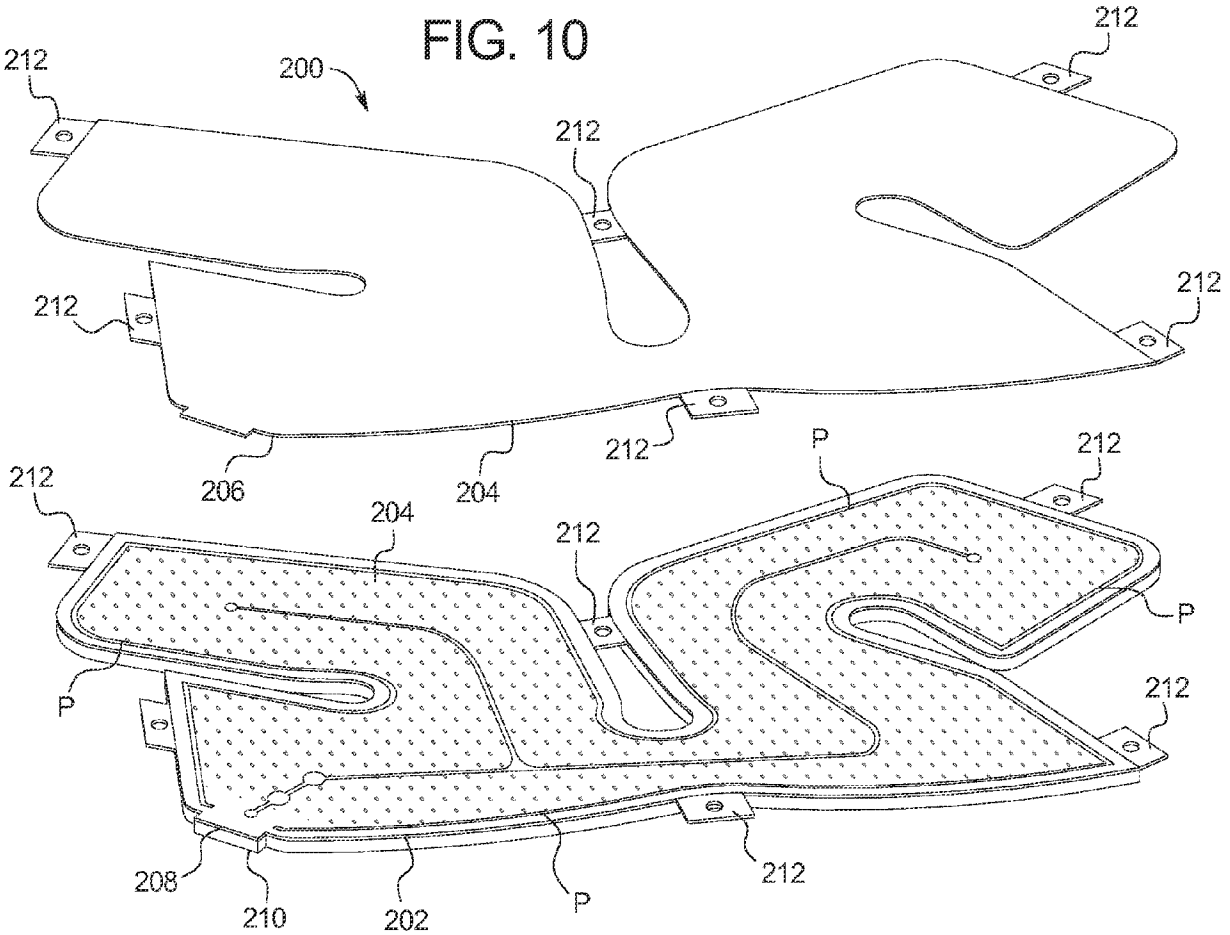
FIG. 10 is a top perspective view of one embodiment of a thermal/compression therapy wrap of the present disclosure having an outer air compression chamber made of an outer sheet that is larger than the inner sheets to allow the wrap to be more easily wrapped and inflated about a user's limb.

Regarding wrap alternative (i), the outer surface of the outer air compression layer is in one embodiment resistant to stretching so as to be able to provide efficient compression. This can cause wrinkling and bunching of the inner water cooling layer when the length of both layers is the same in (i). As a remedy, it is contemplated in FIG. 10 to make wrap alternative (ii), in which sheet 206 is made to be slightly larger, at least along certain lengths, than sheet 208, which is in turn made to be slightly lager, at least along certain lengths, than sheet 210. Sheets 206 and 208 (made of any of the materials discussed above) are sealed (using any technique discussed herein) together along periphery P to form an outer air compression chamber 204. Sheets 206 and 208 (made of any of the materials discussed above) are sealed together (using any technique discussed herein) along periphery P to form an inner thermal water chamber 202. Three sheets 206, 208 and 210 can be sealed together at the same time, using the same process.

Alignment tabs 212 align the three sheets 206, 208 and 210 during the sealing process. The alignment tabs 212 cause the extra material of larger sheets 206 and 208 to bunch in the middle of periphery P. This extra, bunched material is then available to expand when chambers 202 and 204 are subject to water and air inflation, respectively, so that outer sheets 206 and 208 place less stress on their neighboring inner sheet due to the expanded radii of the outer sheets 206 and 208. The additional material allows wrap 200 when inflated to be under less overall stress, lessening the likelihood that inner sheets 204 and 206 will bunch or crinkle.

Additional Aspects of the Present Disclosure

Aspects of the subject matter described herein may be useful alone or in combination one or more other aspect described herein. Without limiting the foregoing description, in a first aspect of the present disclosure, a pressure therapy system includes: an air pump; a pneumatic line pressurized by the air pump; and a cuff in fluid communication with the pneumatic line, the cuff including flaps sized and shaped to extend around a user's limb, a first chamber and a second chamber separated fluidly by the cuff from the first chamber, wherein the pneumatic line splits into first and second line segments or openings, the first line segment or opening communicating fluidly with the first separated chamber, the second line segment or opening communicating fluidly with the second separated chamber, and wherein the second line segment or opening or a pathway of the cuff leading to the second separated chamber includes a flow restricting structure that delays pressurized air from reaching the second chamber relative to the first chamber.

In accordance with a second aspect of the present disclosure, which may be used in combination with any other aspect listed herein, the cuff is structured so that the first chamber is located distal from the second chamber relative to the user's heart when worn around the user's limb.

In accordance with a third aspect of the present disclosure, which may be used in combination with any other aspect listed herein, the cuff is removably attachable around the user's limb.

In accordance with a fourth aspect of the present disclosure, which may be used in combination with any other aspect listed herein, the first and second separated chambers are located on the cuff inside of the flaps.

In accordance with a fifth aspect of the present disclosure, which may be used in combination with any other aspect listed herein, the flow restricting structure includes a narrowed passageway located in the second line segment or opening.

In accordance with a sixth aspect of the present disclosure, which may be used in combination with any other aspect listed herein including the fifth aspect, the narrowed passageway is located in a connector connecting the pneumatic line with the first and second line segments or openings.

In accordance with a seventh aspect of the present disclosure, which may be used in combination with any other aspect listed herein, the flow restricting structure includes a tortuous air flow restriction in the pathway of the cuff leading to the second separated chamber.

In accordance with an eighth aspect of the present disclosure, which may be used in combination with any other aspect listed herein including the seventh aspect, the tortuous air flow restriction includes alternating baffles in the pathway.

In accordance with a ninth aspect of the present disclosure, which may be used in combination with any other aspect listed herein including the seventh aspect, the first and second separated chambers and the tortuous air flow restrictions are sealed via heat sealing, sonic sealing or solvent bond.

In accordance with a tenth aspect of the present disclosure, which may be used in combination with any other aspect listed herein including the seventh aspect, the flow restricting structure includes (i) the tortuous air flow restriction in the pathway and (ii) a narrowed passageway located in the second line segment or opening.

In accordance with an eleventh aspect of the present disclosure, which may be used in combination with any other aspect listed herein, the flow restricting structure includes a check valve located in the second line segment or opening.

In accordance with a twelfth aspect of the present disclosure, which may be used in combination with other aspect listed herein including the eleventh aspect, the check valve is located in a connector connecting the pneumatic line with the first and second line segments or openings.

In accordance with a thirteenth aspect of the present disclosure, which may be used in combination with other aspect listed herein including the eleventh aspect, the flow restricting structure includes (i) the check valve located in the second line segment or opening and (ii) a tortuous air flow restriction in the pathway of the cuff leading to the second separated chamber.

In accordance with a fourteenth aspect of the present disclosure, which may be used in combination with any other aspect listed herein, the system includes a reservoir, the air pump pressurizing the pneumatic line via the reservoir.

In accordance with a fifteenth aspect of the present disclosure, which may be used with any other aspect listed herein, the pneumatic line splits outside the cuff.

In accordance with a sixteenth aspect of the present disclosure, which may be used with any other aspect listed herein, the pneumatic line splits inside the cuff.

In accordance with a seventeenth aspect of the present disclosure, which may be used with any other aspect listed herein, a pressure therapy system includes: electronics; an air pump controlled by the electronics; first and second control valves controlled by the electronics; first and second bleed valves controlled by the electronics; a first pneumatic line in fluid communication with the first control valve and the first bleed valve; a second pneumatic line in fluid communication with the second control valve and the second bleed valve; a first cuff in fluid communication with the first pneumatic line, the first cuff including flaps sized and shaped to extend around a user's limb, a distal chamber and a proximal chamber, and wherein the first cuff or the first pneumatic line includes a first flow restricting structure that delays pressurized air from reaching the proximal chamber relative to the distal chamber; a second cuff in fluid communication with the second pneumatic line, the second cuff including flaps sized and shaped to extend around a user's limb, a distal chamber and a proximal chamber, and wherein the second cuff or the second pneumatic line includes a second flow restricting structure that delays pressurized air from reaching the proximal chamber relative to the distal chamber; and wherein the electronics is configured to open and close the first and second control valves and the first and second bleed valves so that pressurization of the first and second cuffs is staggered, lessening an amount of pressurization needed.

In accordance with an eighteenth aspect of the present disclosure, which may be used with any other aspect listed herein including the seventeenth aspect, the system includes a third pneumatic line leading to a pneumatic chamber of a wrap, the wrap further including a liquid chamber.

In accordance with a nineteenth aspect of the present disclosure, which may be used with any other aspect listed herein including the eighteenth aspect, the system includes a liquid pump in fluid communication with the liquid chamber.

In accordance with a twentieth aspect of the present disclosure, which may be used with any other aspect listed herein including the eighteenth aspect, the electronics is configured to cause the pressure in the pneumatic chamber of the wrap to be ramped up and down linearly.

In accordance with a twenty-first aspect of the present disclosure, which may be used with any other aspect listed herein including the eighteenth aspect, the system includes a third control valve and a third bleed valve in fluid communication with the third pneumatic lines, and wherein the electronics is configured to open and close the first, second and third control valves and the first, second and third bleed valves so that pressurization of the first cuff, second cuff and wrap and staggered, lessening the amount of pressurization needed.

In accordance with a twenty-second aspect of the present disclosure, which may be used with any other aspect listed herein, a pressure therapy system includes: an air pump; a pneumatic line pressurized by the air pump; and a cuff in fluid communication with the pneumatic line, the cuff including flaps sized and shaped to extend around a user's limb, a first chamber and a second chamber, an inlet check valve and an outlet check valve communicating fluidly with the second air chamber, the inlet check valve delaying pressurized air from reaching the second chamber relative to the first chamber when pressure is applied to the pneumatic line, the outlet check valve enabling pressure in the second chamber to dissipate when the pneumatic line is depressurized.

In accordance with a twenty-third aspect of the present disclosure, which may be used with any other aspect listed herein including the twenty-second aspect, the inlet and outlet check valves are provided in a connector that communicate fluidly with the first and second chambers.

In accordance with a twenty-fourth aspect of the present disclosure, which may be used with any other aspect listed herein, the second chamber is separated fluidly by the cuff from the first chamber, wherein the pneumatic line splits into first and second line segments or openings, the first line segment or opening communicating fluidly with the first separated chamber, the second line segment or opening communicating fluidly with the second separated chamber, and wherein the second line segment or opening or a pathway of the cuff leading to the second separated chamber includes the inlet and outlet check valves.

In accordance with a twenty-fifth aspect of the present disclosure, any of the structure and functionality illustrated and described in connection with FIGS. 1 to 10 may be used in combination with any aspect listed herein.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A pressure therapy system comprising:

an air pump;

a pneumatic line pressurized by the air pump; and a cuff in fluid communication with the pneumatic line, the cuff including flaps sized and shaped to extend around a user's limb, a first chamber and a second chamber separated fluidly by the cuff from the first chamber, wherein the pneumatic line splits into first and second line segments or openings, the first line segment communicating fluidly with the first separated chamber, the second line segment communicating fluidly with the second separated chamber, and wherein a pathway of the cuff leading to the second separated chamber includes a tortuous air flow restriction structured and arranged to cause pressurized air to travel in a serpentine manner such that that the pressurized air is redirected at least twice in the pathway, thereby delaying the pressurized air from reaching the second chamber relative to the first chamber.

2. The pressure therapy system of claim 1, wherein the cuff is structured so that the first chamber is located distal from the second chamber relative to the user's heart when worn around the user's limb.

3. The pressure therapy system of claim 1, wherein the cuff is removably attachable around the user's limb.

4. The pressure therapy system of claim 1, wherein the first and second separated chambers are located on the cuff inside of the flaps.

5. The pressure therapy system of claim 1, wherein the tortuous air flow restriction includes alternating baffles.

6. The pressure therapy system of claim 5, wherein the alternating baffles include at least three baffles located in the pathway.

7. The pressure therapy system of claim 5, wherein each of the alternating baffles in the pathway includes a free end extending in the pathway, the baffles constructed and arranged to cause the pressurized air to travel in the serpentine manner by flowing the air around each of the free ends, thereby delaying the pressurized air from reaching the second chamber relative to the first chamber.

8. The pressure therapy system of claim 5, wherein the alternating baffles are at least substantially parallel to each other.

9. The pressure therapy system of claim 1, wherein the first and second separated chambers and the tortuous air flow restriction are sealed via heat sealing, sonic sealing or solvent bond.

10. The pressure therapy system of claim 1, which includes a reservoir, the air pump pressurizing the pneumatic line via the reservoir.

11. The pressure therapy system of claim 1, wherein the pneumatic line splits outside the cuff.

12. The pressure therapy system of claim 1, wherein the pneumatic line splits inside the cuff.

13. A pressure therapy system comprising:

an air pump;

a pneumatic line pressurized by the air pump; and a cuff in fluid communication with the pneumatic line, the cuff including flaps sized and shaped to extend around a user's limb, a first chamber and a second chamber, an inlet duck-billed check valve facing a first direction and located within a connector that communicates fluidly with the first and second chambers, the inlet check valve delaying pressurized air from reaching the second chamber relative to the first chamber when pressure is applied to the pneumatic line, and an outlet duck-billed check valve facing a direction opposite the first direction located within the connector communicating fluidly with the first and second chambers, the outlet check valve communicating fluidly with the second air chamber and enabling pressure in the second chamber to dissipate when the pneumatic line is depressurized.

14. The pressure therapy system of claim 13, wherein the second chamber is separated fluidly by the cuff from the first chamber, wherein the pneumatic line splits into first and second line segments or openings, the first line segment or opening communicating fluidly with the first separated chamber, the second line segment or opening communicating fluidly with the second separated chamber, and wherein the second line segment or opening includes the inlet and outlet check valves.

* * * * *